US006729743B2

(12) United States Patent
Gillette

(10) Patent No.: US 6,729,743 B2
(45) Date of Patent: May 4, 2004

(54) FLASHLIGHT WITH BRACKET DEVICE FOR CORDLESS DRILL

(75) Inventor: Jay V. Gillette, Thornton, PA (US)

(73) Assignee: Jay V Gillette, Thornton, PA (US)

( * ) Notice: Subject to any disclaimer, the term of this patent is extended or adjusted under 35 U.S.C. 154(b) by 0 days.

(21) Appl. No.: 10/233,636

(22) Filed: Sep. 4, 2002

(65) Prior Publication Data

US 2003/0058638 A1 Mar. 27, 2003

Related U.S. Application Data

(60) Provisional application No. 60/317,363, filed on Sep. 21, 2001, and provisional application No. 60/322,686, filed on Oct. 15, 2001.

(51) Int. Cl.[7] ..... F21L 4/00

(52) U.S. Cl. ..... 362/191; 362/109; 362/119; 362/253

(58) Field of Search ..... 362/109, 119, 362/120, 190, 191, 208, 253

(56) References Cited

U.S. PATENT DOCUMENTS 2,517,882 A 8/1950 Johnson
2,525,588 A 10/1950 Cameron et al.
2,588,288 A 3/1952 Pohanka
2,822,615 A 2/1958 Durst et al.
3,739,167 A 6/1973 Avery
3,977,278 A 8/1976 Jackson
4,403,957 A 9/1983 Mossle et al.
4,833,782 A 5/1989 Smith
5,169,225 A 12/1992 Palm
5,313,376 A 5/1994 McIntosh
5,560,703 A 10/1996 Capps, III
5,797,670 A 8/1998 Snoke et al.
6,168,287 B1 * 1/2001 Liu ..... 362/119
6,179,436 B1 1/2001 Gitkind
6,206,538 B1 3/2001 Lemoine

* cited by examiner

*Primary Examiner*—Stephen F Husar

(57) ABSTRACT

A flashlight and bracket device attachable to a cordless drill for illuminating the drilling region. The bracket clips into the screwdriver bit holder cavity of any cordless drill. The bracket and flashlight case can be plastic and molded in one unit. A metal flashlight case can have a plastic or metal bracket attached by fastening with adhesive, rivets, bolts, wire ties, and welding. The bracket has a rectangular element attached to the flashlight case and a cylindrical element which snaps into a spring clip in a cavity in the housing of the cordless drill.

5 Claims, 3 Drawing Sheets

FLASHLIGHT WITH BRACKET DEVICE FOR CORDLESS DRILL

This application claims the benefit of U.S. Provisional Patent Application Ser. No. 60/317,363, filed on Sep. 21, 2001, and Ser. No. 60/322,686, filed on Oct. 15, 2001.

BACKGROUND OF THE INVENTION

1. Field of the Invention

The present invention relates generally to a flashlight attachable to a cordless drill. More specifically, the invention is a flashlight case having a bracket which is adapted for attachment to a conventional spare bit holder built-in to the housing of a cordless drill in order to provide illumination while drilling.

2. Description of the Related Art

The related art of interest describes various portable power tools utilizing an accessory light in various locations, but none discloses the present invention which provides for attaching a flashlight onto a portable drill by means of a bracket attached to the flashlight case which snaps into a conventional bit holder(s) in the portable drill housing. There is a need for a small illumination source for a portable drill, and particularly a cordless drill, which can be readily attached to the drill to greatly assist in the drilling process, especially in a small, crowded, and shaded areas. The related art will be discussed in the order of perceived relevance to the present invention.

U.S. Pat. No. 2,822,615, issued on Feb. 11, 1958, to Charlie I. Durst describes a drill attachment precision verifier for a portable electric drill comprising a cylindrical sighting light device placed either on top or on either side of a portable electric drill. Inside the device is a light bulb in the rear actuated with a suitable light source by an external wire and light switch. The sighting device has the light traveling through a first convex-convex lens, a first cross-shaped sight, a second cross-shaped sight, and out the second convex-concave lens. The sighting device is attached to a U-shaped body member which has flanges for sliding in a track mounted on top of the drill. The device is distinguishable for requiring an external electrical source, two lens, and two cross-shaped sights.

U.S. Pat. No. 5,797,670 issued on Aug. 25, 1998, to Phillip J. Snoke et al. describes a portable power tool light accessory with a mounting belt comprising a light supported by a flexible neck and a body attached by a detachable mounting belt around the portable drill in front of the trigger. The device is distinguishable for requiring a flexible neck and the mounting belt.

U.S. Pat. No. 3,977,278, issued on Aug. 31, 1976, to John Van Jackson describes a light positioned on top of the housing of an automotive impact wrench energized by a car battery. The light housing is integral with the tool housing and has wiring energized by a light switch on the side of the tool body. The light device is distinguishable for being integrated with the power tool body.

U.S. Pat. No. 6,206,538 B1, issued on Mar. 27, 2001, to David B. Lemoine describes a miser light for a cordless battery operated drill located on various positions such as on top, below, or on the bottom battery case. The drill has a spring return trigger switch assembly which energizes the lamp first. The light source may be an incandescent or a halogen bulb matched to the output voltage of the tool battery. There is no disclosure as to the means of attachment of the lamp to the drill. The miser light is distinguishable for its lack of description for the housing and its attachment to the drill.

U.S. Pat. No. 4,833,752, issued on May 30, 1989, to Lonnie W. Smith describes a saber saw tracing light comprising a focused miniature electric lamp with a focusing mechanism projecting a very narrow beam of light mounted permanently on the front of the saw blade to trace the previously scribed saw line. The illumination device is distinguishable for requiring a non-detachable miniature electric lamp.

U.S. Pat. No. 2,525,588, issued on Oct. 10, 1950, to Leroy F. Cameron describes an illuminated electric drill having an electric lamp with a focusing lens built into the front housing below the drill chuck and energized along with the drill. The illumination source is distinguishable for its required built-in front location.

U.S. Pat. No. 2,517,882, issued on Aug. 8, 1950, to Moses Johnson describes illuminated handheld motor tools, such as buffers, grinders and drills. The cylindrical handheld drill has an offset lamp housing and a transparent nozzle either on one side of the right-angled chuck or aligned with an in-line chuck. The illumination means is distinguishable for requiring an integrated lamp and an angled or straight transparent nozzle.

U.S. Pat. No. 5,169,225, issued on Dec. 6, 1992, to Bernhard Palm describes a portable power tool with a light on a slider attached to the battery pack located at the bottom of its pistol handle for illumination of the work area. The light means is distinguishable for being required to attach to the bottom of the pistol handle.

U.S. Pat. No. 5,560,703, issued on Oct. 1, 1996, to Lewis W. Capps describes a mounting device for mounting a flashlight on a handgun. The device has a first bracket for attachment to the grip of the handgun, the bracket being contoured to the surface of the handgun grip and engageable with the grip by friction. The bracket, which engages the grip, extends partially around the grip and is further urged against the grip by means of an elastic band. The first bracket is connected to a second bracket which holds a flashlight under the grip in a desired alignment for coinciding with the gun barrel. The second bracket is located away from the grip except for an upper region that is welded flush to the first bracket so that it does not interfere with normal gripping of the gun. The device is distinguishable for requiring two brackets and being located on the bottom of the handle.

U.S. Pat. No. 6,179,436 B1, issued on Jan. 30, 2001, to Neil Gitkind describes a backpack lantern of a flashlight combined in the center of an elastomeric coupler having two to four legs with hook fastening patches on their ends to engage the ring of loop fastening on the upper part of a capped drinking container. The device is distinguishable for requiring the flashlight to be fastened to a drinking container.

U.S. Pat. No. 6,179,436 B1, issued on Jan. 30, 2001, to Neil Gitkind describes a light source attachment to a drink container for use as a lantern for the home or when camping, comprising a flashlight with its head portion coupled to the open end of the cup with elastomeric couplers with up to four legs having hook fastening patches for attaching to a ring of loop fastening on the rim of the cup. The flashlight and its attachment are distinguishable for requiring elastomeric coupling.

U.S. Pat. No. 2,588,288, issued on Mar. 4, 1952, to Joseph Pohanka describes a dental light comprising a socket member and a rear nipple holding the lamp with its outwardly flaring reflector adjacent the dental burr by a C-shaped metal clamp on the drill handle. The device is distinguishable for requiring a lamp with an angled socket member and rear nipple attachable by a C-shaped clamp.

U.S. Pat. No. 5,313,376 issued on May 17, 1994, to Kirk W. McIntosh describes an illuminated multifunctional pocket knife and light device comprising a hollow channel above the integrated knife handle for the lamp and battery. FIG. 8 describes a detachable flashlight body with a locking tracking means attached to a truncated triangular slot on the top of the main knife case. The flashlight body contains the bulb and battery, but lacks a switch. The device is distinguishable for being limited to attachment to a pocket knife.

U.S. Pat. No. 3,739,167, issued on Jun. 12, 1973, to Glen H. Avery describes a spot light for a rifle or a bow in night hunting comprising a spotlight attached perpendicular to a vertical standard attached below the gun barrel. The battery is behind the standard and connected by exposed wiring to the lamp and the switch located on the rifle stock. The device is distinguishable for requiring a spotlight and a standard.

U.S. Pat. No. 4,403,957, issued on Sep. 13, 1983, and German Patent Application No. DE 31 19 689 A1, published on Dec. 2, 1982, for Walter Moessle al. describes a dental drill with an integrated light. The device is distinguishable for its limitation to and integrated in a dental drill.

None of the above inventions and patents, taken either singly or in combination, is seen to describe the instant invention as claimed. Thus, a cordless drill flashlight case and bracket device solving the aforementioned problem of illumination for a cordless drill is desired.

SUMMARY OF THE INVENTION

The present invention is a flashlight and bracket attachment for a cordless drill. The illumination is necessary in dark areas such as inside cabinets, closets, attics, and for basement ceilings, and the like. Conventional portable drills now have one or two storage spaces inside a cavity molded into the drill body and having a clip holder for screwdriver bits. Therefore, according to the present invention, the flashlight has a bracket attached on the side of the flashlight case, the bracket comprising a rectangular base element and a cylindrical element for insertion in the clip holder. In this manner, advantage is taken of the existing clip holder.

Accordingly, it is a principal object of the invention to provide an illumination source attachment device for a cordless drill having an integrated screwdriver bit holder.

It is another object of the invention to provide a flashlight with a holder device for fitting the modified screwdriver bit holder cavity of a cordless drill.

It is a further object of the invention to provide a holder component having a cylindrical attachment element for removable attachment to the cordless drill.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
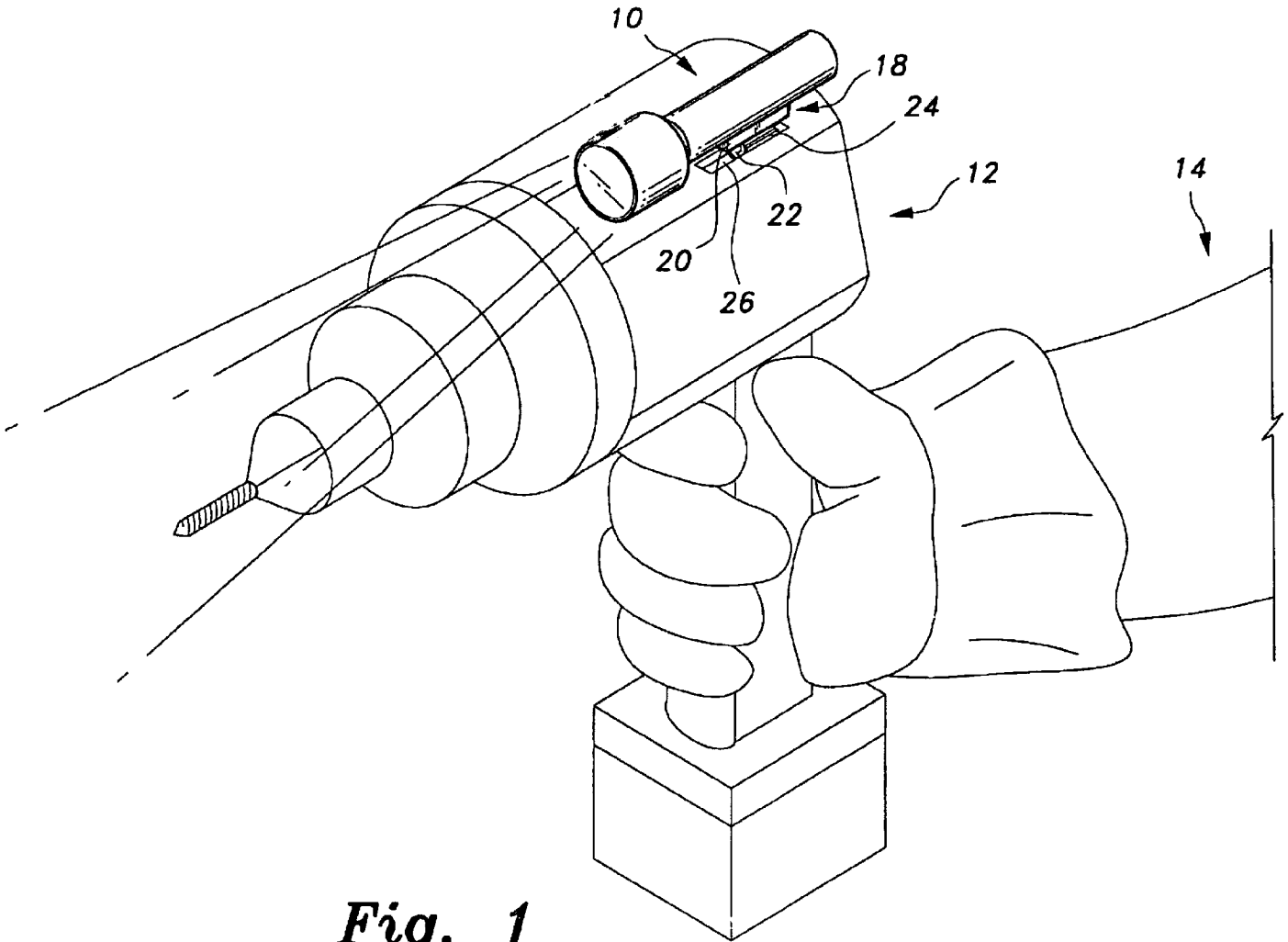
FIG. 1 is an environmental, perspective view of a worker's hand using a cordless drill with the flashlight and bracket holder device according to the present invention illuminating the drilling area.
Figure 2:
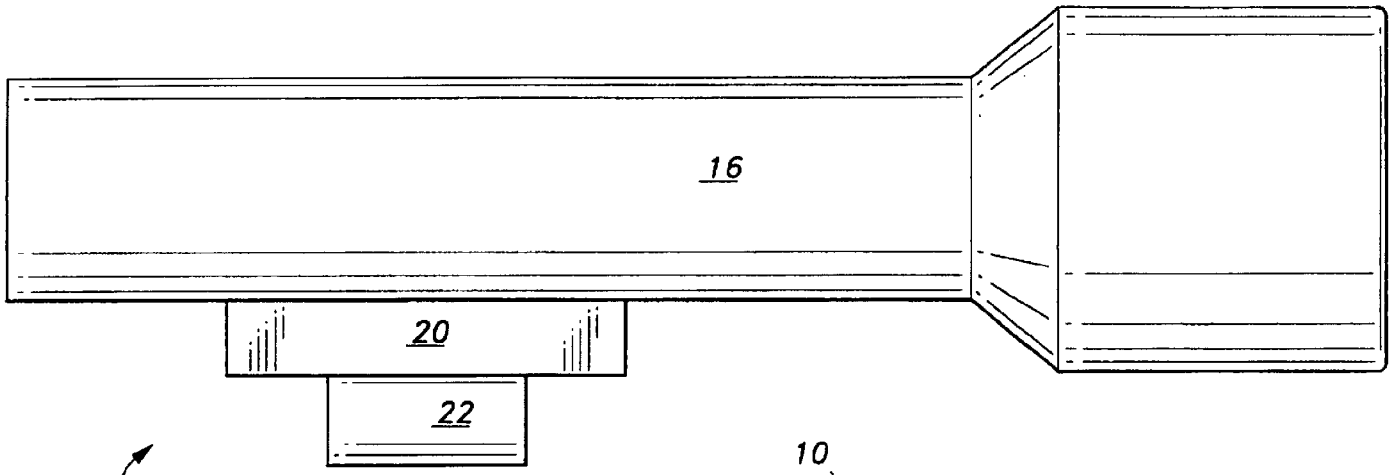
FIG. 2 is a side elevational view of the flashlight and bracket holder device according to the present invention.
Figure 3:
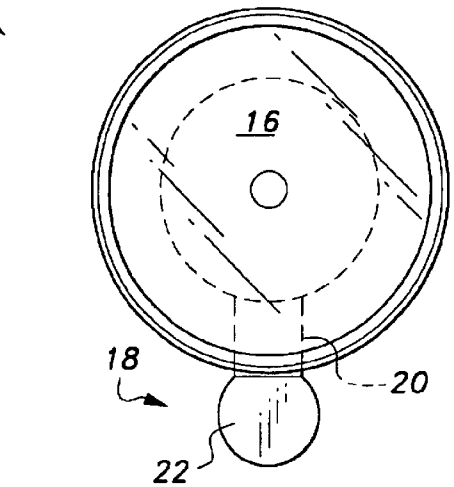
FIG. 3 is a front elevational view of the flashlight and bracket holder device according to the present invention.

The present invention, as shown in FIG. 1, is directed to a flashlight and bracket device 10 for attachment to a cordless drill 12 to provide illumination on the work area for the worker 14 using the drill 12. As depicted in FIGS. 1, 2 and 3, a conventional battery operated flashlight 16 has a holder element or bracket 18 consisting of two contiguous parts, namely, a rectangular base element 20 and a cylindrical element 22 adapted for being gripped by the spring clip 24 (partially hidden in FIG. 1) in the cavity 26 in the body of the drill 12. These cavities 26 are conventionally molded in a cordless drill 12 on opposite sides for holding screwdriver bits.

The flashlight 16 has the bracket 18 attached by any of the following methods, including riveting, bolting, welding, gluing, wire ties, and the like. Alternatively, the bracket 18 may be formed in one piece with the flashlight case by molding, etc. The flashlight 16, shown schematically in the drawings, is battery powered and has an otherwise conventional case including a barrel for containing the batteries and a head housing a bulb, reflector, and lens. The flashlight 16 may have an external on/off switch, or may have on/off switch operated by rotating the head section.

Figure 4:
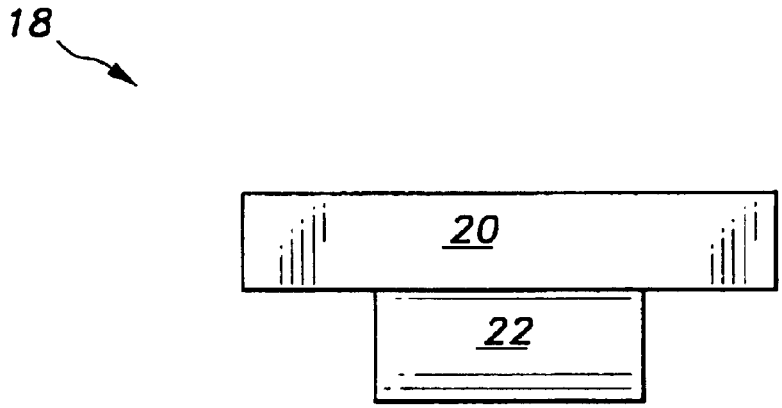
FIG. 4 is a side elevational view of the bracket holder element according to the present invention.
Figure 5:
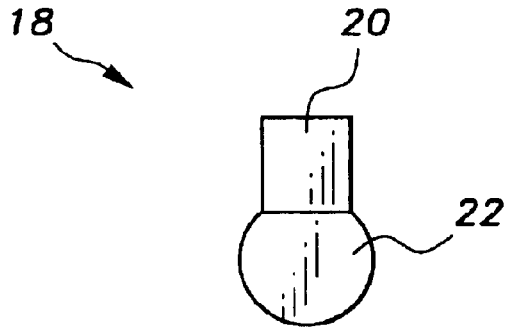
FIG. 5 is a front elevational view of the bracket holder element according to the present invention.

FIGS. 4 and 5 illustrate a side view and a front or rear view, respectively of the configuration of the bracket 18, including the rectangular base element 20 and the integral cylindrical element 22. These elements 20 and 22 can be made in one piece by molding or attached by welding and the like as noted above. The bracket 18 may be made from any suitable material, including steel, aluminum, copper, die cast alloys, plastics, hard rubber, wood, etc.

Thus, a flashlight combined with a simplified holder element can be immediately attached to a cordless drill having at least one cavity with a holding clip for a screwdriver or a drill bit, or for holding a chuck key.

It is to be understood that the present invention is not limited to the embodiment described above, but encompasses any and all embodiments within the scope of the following claims.

I claim:

1. A cordless drill flashlight and bracket device for attachment to a cordless drill, the drill having a housing with a cavity defined therein and a spring clip for holding a screwdriver bit, the flashlight and bracket device comprising:

a flashlight having a case including a cylindrical barrel;

a bracket having:

a flat elongated rectangular element attached the flashlight case; and a cylindrical element integral with the rectangular element, the cylindrical element being dimensioned and configured for snapping into the spring clip in the cavity defined in the cordless drill housing;

whereby the flashlight provides illumination when using the cordless drill.

2. The cordless drill flashlight case and bracket device according to claim 1, wherein said bracket component has a longitudinal axis aligned with a longitudinal axis of the barrel of the flashlight case.

3. The cordless drill flashlight case and bracket device according to claim 1, wherein the bracket is made of a material selected from the group consisting of metal and plastic.

4. The cordless drill flashlight case and bracket device according to claim 1, wherein the bracket and the flashlight case are made of plastic and molded in one piece.

5. The cordless drill flashlight case and bracket device according to claim 1, wherein the bracket is made from a material selected from the group consisting of steel, aluminum, copper, die cast alloys, plastics, hard rubber, wood.

* * * * *